US006383349B1

(12) United States Patent
Sakata et al.

(10) Patent No.: US 6,383,349 B1
(45) Date of Patent: May 7, 2002

(54) ELECTROLYTIC CELL USING GAS DIFFUSION ELECTRODE AND POWER DISTRIBUTION METHOD FOR THE ELECTROLYTIC CELL

(75) Inventors: Akihiro Sakata, Tokyo; Koji Saiki, Osaka; Hiroaki Aikawa, Tokyo; Shinji Katayama, Okayama; Kenzo Yamaguchi, Tokyo, all of (JP)

(73) Assignees: Toagosei Co., Ltd.; Mitsui Chemicals, Inc., both of Tokyo; Kaneka Corporation, Osaka; Chlorine Engineers Corp., Ltd., Tokyo, all of (JP)

( * ) Notice: Subject to any disclaimer, the term of this patent is extended or adjusted under 35 U.S.C. 154(b) by 0 days.

(21) Appl. No.: 09/701,418

(22) PCT Filed: Mar. 28, 2000

(86) PCT No.: PCT/JP00/01921

§ 371 Date: Nov. 29, 2000

§ 102(e) Date: Nov. 29, 2000

(87) PCT Pub. No.: WO00/60140

PCT Pub. Date: Oct. 12, 2000

(30) Foreign Application Priority Data

| | | |
|---|---|---|
| Mar. 31, 1999 | (JP) | 11-093440 |
| Mar. 31, 1999 | (JP) | 11-093589 |
| Mar. 31, 1999 | (JP) | 11-093590 |
| Mar. 31, 1999 | (JP) | 11-093591 |
| Mar. 31, 1999 | (JP) | 11-093592 |
| Mar. 31, 1999 | (JP) | 11-093593 |

(51) Int. Cl.[7] ..... C25B 9/08

(52) U.S. Cl. ..... 204/263; 204/265; 204/266

(58) Field of Search ..... 204/263, 265, 204/266, 277, 278, 275.1

(56) References Cited

U.S. PATENT DOCUMENTS

| | | | | | |
|---|---|---|---|---|---|
| 6,113,757 | A | * | 9/2000 | Shimamune et al. | 204/265 |
| 6,113,773 | A | * | 9/2000 | Shimamune et al. | 204/265 |
| 6,165,332 | A | * | 12/2000 | Gestermann et al. | 204/258 |

FOREIGN PATENT DOCUMENTS

| | | |
|---|---|---|
| FR | 2 711 675 | 5/1995 |
| JP | 5-271974 | 10/1993 |
| JP | 7-207482 | 8/1995 |
| JP | 10-219488 | 8/1998 |

* cited by examiner

*Primary Examiner*—Bruce F. Bell
(74) *Attorney, Agent, or Firm*—Young & Thompson

(57) ABSTRACT

An electrolytic cell using an oxygen cathode, for use in an ion-exchange membrane electrolytic soda process or the like, the electrolytic cell having; a structure, wherein, for effective supply and discharge of a caustic liquid and for an effective handling of a caustic liquid leakage, provided on an outer-side edge of the electrolytic cell are an upper chamber as a caustic liquid discharge outlet, a lower chamber as a caustic liquid introduction inlet, and a caustic-liquid room frame connected via a caustic liquid passage to thereby reduce a caustic liquid leakage; a structure, wherein a lower gas chamber is provided at the lower outer end of a cathode element to thereby handle a caustic liquid leakage from a gas diffusion electrode to a gas room; or a structure which uses a gas-liquid permeating gas diffusion electrode to supply an oxygen gas from an upper chamber communicating with a gas room and discharge a gas and a caustic liquid into a lower chamber.

8 Claims, 11 Drawing Sheets

ELECTROLYTIC CELL USING GAS DIFFUSION ELECTRODE AND POWER DISTRIBUTION METHOD FOR THE ELECTROLYTIC CELL

TECHNICAL FIELD

The present invention relates to electrolytic cells employing an oxygen cathode which are used for, e.g., sodium chloride electrolysis by the ion-exchange membrane method. More particularly, the invention relates to electrolytic cells employing a gas diffusion electrode as an oxygen cathode which can be improved in any of the following: a caustic solution can be effectively fed and discharged; caustic solution leakage through the gas diffusion electrode into the gas chamber can be effectively and appropriately coped with; a caustic chamber serving as an electrolytic solution passageway can be constituted so as to have an exceedingly small thickness; oxygen gas can be evenly fed to and discharged from the gas chamber having the gas diffusion electrode; a gas- and liquid-permeable gas diffusion electrode is used as the gas diffusion electrode to thereby enable a stable electrolytic operation to be continued at a high current efficiency; and power distribution in the electrolytic cell employing a gas diffusion electrode can be conducted so as to apply a voltage to a large area without considerably modifying the structure of a conventional electrolytic cell.

BACKGROUND ART

An electrolytic cell employing an anode, an ion-exchange membrane, and an oxygen cathode comprising a gas diffusion electrode has hitherto been proposed for use in sodium chloride electrolysis or Glauber's salt electrolysis.

In such a conventional electrolytic cell employing a gas diffusion electrode, e.g., an electrolytic cell for sodium chloride electrolysis, the electrolytic cell is constituted of elements including a cathode element, cathode collector frame, and caustic chamber frame and these elements have been assembled together with gaskets interposed therebetween. A caustic solution is fed and discharged through liquid inlets and outlets of a caustic chamber disposed in the cathode element. Since this electrolytic cell has the constitution described above, it necessitates gaskets for assembly.

Because of this, this electrolytic cell has a complicated structure and has had a problem that there is a high possibility that the caustic solution might leak out due to a decrease in sealing properties in the joints between members, e.g., in the gaskets.

This electrolytic cell has further had a problem that although there is a possibility that the caustic chamber of the cathode element might suffer electrolytic corrosion, it is difficult to plate the caustic chamber with a metal having resistance to corrosion by NaOH, e.g., silver, for corrosion prevention because the chamber has a complicated structure.

Furthermore, in the conventional ion-exchange membrane type electrolytic cell for sodium chloride electrolysis, in the case where a gas diffusion electrode is used as an oxygen cathode in place of the gas generation type cathode, a gas diffusion electrode which is liquid-impermeable is usually employed to constitute the electrolytic cell so as to have three chambers. In such a case, since the electrolytic cell for practical use has a height of 1.2 m or higher and the solution chamber thereof is filled with an electrolytic solution, a high fluid pressure attributable to the electrolytic solution is applied to a lower part of the gas diffusion electrode and this is causative of liquid leakage from the catholyte chamber to the gas chamber.

When a gas diffusion electrode is attached to such a vertical electrolytic cell and an electrolytic solution is fed thereto, then a difference in fluid pressure results. Namely, a high fluid pressure is applied to a lower part of the gas diffusion electrode as stated above, whereas almost no fluid pressure is applied to an upper part. This difference in fluid pressure is causative, in the lower part, of liquid leakage from the catholyte chamber to the gas chamber, and is causative, in the upper part, of gas leakage through the gas diffusion electrode to the electrolytic solution side.

Furthermore, when an actual electrolytic operation is conducted under such conditions that the fluid pressure is higher than the gas pressure for the gas diffusion electrode, then a large amount of the electrolytic solution (caustic solution) leaks out into the gas chamber in the case where the gas diffusion electrode has low water resistance and the sealing is insufficient. There has hence been a problem that this leakage inhibits gas feeding and reduces the electrode performance and electrode life.

In particular, gas diffusion electrodes having low water pressure resistance have limited uses.

In addition, if the gas chamber is filled with a caustic solution, this caustic solution further flows into a lower gas chamber for gas discharge or feeding (which has conventionally been formed in the frame of the electrolytic cell). In this case, since the lower gas chamber is corroded by the caustic solution, the inner surface of the lower gas chamber should be plated beforehand with a metal having resistance to corrosion by NaOH, e.g., silver. In the conventional electrolytic cell, however, it has been difficult to subject the inner surface of the lower gas chamber to corrosion-preventive plating because of the structure thereof. There has been a further problem that although the cathode collector frame has been sealed to the lower gas chamber with a gasket, insufficient sealing permits the caustic solution to flow into the cathode element and corrode the inside of the element. Furthermore, in some electrolytic cells, it has been difficult to attach a gas chamber to the existing cathode element due to the structure of the element.

Many of the gas diffusion electrodes for use in such electrolytic cells are usually composed of two layers, i.e., a reaction layer for subjecting a liquid reactant to an electrolytic reaction and a gas feed layer which is permeable to gases but impermeable to the electrolytic solution.

The reaction layer is constituted of a hydrophilic carbon black having a catalyst supported thereon, a hydrophobic carbon black, and polytetrafluoroethylene (PTFE). The reaction layer is produced by dispersing and self-organizing those materials in various proportions so as to form hydrophilic areas into which an electrolytic solution penetrates and hydrophobic areas to which a gas is fed. The reaction layer thus produced has been attached to a cell and used either as it is or after only the surface thereof is hydrophilized by adhering fine hydrophilic particles to the surface.

Moreover, a technique has been used in which a structure having through-holes and a high porosity is interposed between an ion-exchange membrane and the reaction layer of a gas diffusion electrode in order to secure electrolytic solution passageways between the ion-exchange membrane and the reaction layer of the gas diffusion electrode.

As a result, flows of an electrolytic solution have been secured. However, there has been a problem that the caustic chamber serving as a cathode chamber into which an electrolytic solution is to be introduced has an increased thickness and inevitably has increased electrical resistance and this necessitates use of a higher voltage.

With respect to a gas chamber having a gas diffusion electrode, it has conventionally been known that there is a relationship in which the higher the linear velocity of the oxygen which is in contact with the gas diffusion electrode serving as an oxygen cathode, the higher the rate of diffusion of the oxygen into the electrode.

Because of this, investigations have been made on: a technique for providing a gas chamber formed by press-molding a nickel sheet to form in a central part thereof a depression having the same size as a gas diffusion electrode, using the depression and the gas diffusion electrode to form a gas chamber, inserting into the chamber a nickel mesh serving as a spacer for securing oxygen passageways to constitute a gas chamber for the gas diffusion electrode and thereby form an exclusive gas chamber, forming in this gas chamber a space which enables oxygen to have a linear velocity necessary for sufficient diffusion into the electrode, and further forming a structure which enables oxygen to come into even contact with the gas diffusion electrode; and a gas chamber which is formed by silver-deposited ridges of a metal plate having ridges and grooves and a gas feed layer of a gas diffusion electrode and is produced by bonding the silver present on the ridges of the grooved metal plate with the gas diffusion electrode by hot pressing to thereby use the grooves of the metal plate as gas passageways.

However, these gas chambers having a diffusion electrode each relates to a technique for accelerating oxygen diffusion in the gas chamber and making the diffusion even. There has been an unsolved problem that the even feeding of oxygen gas into a gas chamber and the even discharge thereof are not taken in account at all.

Furthermore, brine electrolysis with a conventional gas diffusion electrode is disadvantageous with respect to the deterioration of the gas diffusion electrode or the recovery of the caustic soda yielded. This electrolysis has had a drawback that long-term operation is impossible or the caustic soda penetrates into the anode chamber to reduce the current efficiency.

An electrolytic cell employing a gas- and liquid-permeable gas diffusion electrode has been proposed as a means for eliminating that drawback (see, for example, Unexamined Published Japanese Patent Application No. 7-126880). In this invention, the concentrated aqueous caustic soda solution which is being yielded is prevented from remaining around the interface between an ion-exchange membrane and a gas diffusion electrode and penetrating through the ion-exchange membrane to the anode chamber side, by using a gas- and liquid-permeable gas diffusion electrode as the gas diffusion electrode. As a result, the caustic soda which is being yielded can be permitted to pass through the gas diffusion electrode to the cathode chamber side and be easily recovered. Thus, the current efficiency in caustic soda generation can be kept high and the anode chamber members having poor alkali resistance can be protected.

However, this electrolytic cell is slightly unsatisfactory in current efficiency and the stability of electrolytic operation, because water and oxygen gas are fed through a substrate, e.g., a porous sheet, to the gas diffusion electrode, which is a material obtained by kneading a carbonaceous material and PTFE, while feeding a dilute aqueous solution of caustic soda and an oxygen-containing gas to the cathode chamber through feed openings. In addition, there has been a problem that the existing cathode frame should be modified and the modification cost is high.

With respect to methods of power distribution in electrolytic cells employing a gas diffusion electrode, the conventional methods of power distribution in electrolytic cells employing a gas diffusion electrode, i.e., methods for the attachment of a gas diffusion electrode and for power discharge, are roughly divided into the following two types.

(1) Power Supply through Periphery of Gas Diffusion Electrode

The peripheral dimensions of a gas diffusion electrode are regulated so that the periphery of the gas diffusion electrode slightly overlaps the gasket-sealed areas of a cathode element or cathode collector frame (pan or plate form). The periphery of this gas diffusion electrode is brought into contact with the gasket-sealed areas of the cathode element or cathode collector frame. A gasket is placed thereon, and the whole electrolytic cell is assembled and fastened, whereby the contact areas also are fastened. In this method, a current is permitted to flow from these fastened areas.

(2) Cathode Collector Frame-Gas Diffusion Electrode Integration

A catalyst layer of a sheet-form gas diffusion electrode is placed on a metal gauze which is for use in a gas chamber and has been attached to a cathode collector frame. This assemblage is pressed with a pressing machine at a high temperature and a high pressure to sinter the catalyst and simultaneously unite the metal gauze for a gas chamber with the catalyst layer. In this method, power is thereby discharged to the cathode collector frame and cathode element through the gas diffusion electrode.

However, such conventional methods for the attachment of a gas diffusion electrode and for power discharge have had the following problems due to their actions and functions (a) Power Supply through Periphery of Gas Diffusion Electrode In small electrolytic cells, an appropriate conduction area can be secured. However, in practical electrolytic cells having a reaction area (electrode area) of 3 $m^2$, a sufficient conduction area cannot be secured and this part has increased contact resistance. Furthermore, in large electrolytic cells, the sides of the reaction area each has a length of at least 1 m. Even when the gas diffusion electrode contains a conductor therein, this conductor has high electrical resistance, i.e., the structure has increased resistance. The operation of such large electrolytic cells is hence inferior in profitability. In addition, in the case where a gas diffusion electrode having low strength is used and pressed with a gasket, the gas electrode breaks in the pressed parts to cause leakage of oxygen and caustic soda solution through these parts.

(b) Cathode Collector Frame-Gas Diffusion Electrode Integration

Since practical electrolytic cells have a reaction area of about 3 $m^2$, integration of a gas diffusion electrode with a cathode collector frame necessitates a huge pressing machine and pressing mold and is uneconomical.

Furthermore, even when a gas diffusion electrode and a cathode collector frame are united with each other, the assembly of these having a size as large as 3 $m^2$ has an exceedingly small thickness for the size and is flimsy. Consequently, the assembly has considerably low strength and, hence, it is exceedingly difficult to transport it from the pressing factory to a place where an electric cell is to be assembled. This is a problem common also to the method of "Power Supply through Periphery of Gas Diffusion Electrode" described above.

Moreover, in the case where the gas diffusion electrode is replaced with a fresh one, it is difficult to remove the catalyst layer from the collector frame. It is hence necessary to finally replace the whole collector frame with a fresh one, and this is uneconomical.

SUMMARY OF THE INVENTION

The invention has been achieved in view of such conventional problems. An object of the invention is to provide an electrolytic cell which employs a gas diffusion electrode and has a simple structure and in which a conventional electrolytic cell can be used as it is and a chamber capable of being easily subjected to corrosion-preventive metal plating can be used to completely prevent the leakage of caustic solution.

Another object of the invention is to provide an electrolytic cell in which a lower gas chamber is disposed at the lower outer edge of the cathode element, whereby caustic solution leakage through a gas diffusion electrode into a gas chamber can be effectively and appropriately coped with.

Still another object of the invention is to provide an electrolytic cell which employs an oxygen cathode and in which the thickness of a caustic chamber is reduced as much as possible to thereby attain a reduced energy loss and a reduced voltage.

A further object of the invention is to provide an electrolytic cell in which chambers having many holes for oxygen gas feed and discharge are attached to a cathode collector frame to thereby enable oxygen gas to be evenly fed to and discharged from a gas chamber having a gas diffusion electrode.

A still further object of the invention is to provide a constitution in which oxygen gas can be evenly fed to and discharged from a gas chamber having a gas diffusion electrode without modifying the structure of a conventional electrolytic cell.

A still further object of the invention is to provide an electrolytic cell in which water and oxygen gas are directly introduced into a conductive porous material which is a gas chamber component disposed between a gas diffusion electrode and a cathode collector frame and used for power supply to the gas diffusion electrode, whereby a higher current efficiency and a more stable electrolytic operation can be continued.

A still further object of the invention is to provide a method of power distribution in an electrolytic cell employing a gas diffusion electrode, which can be speedily carried out at low cost without necessitating a modification of an existing cathode element at all.

According to the invention, those objects of the invention are accomplished specifically by the following means.

1. An electrolytic cell employing an anode, an ion-exchange membrane and an oxygen cathode comprising a gas diffusion electrode, characterized in that a caustic chamber frame comprising an upper chamber, as caustic solution discharge openings, and a lower chamber, as caustic solution introduction openings, which are connected to each other through caustic solution passageways is disposed at outer edges of the electrolytic cell which comprises: a gas chamber having oxygen gas outlets and inlets for the gas diffusion electrode which meet upper-and lower-chamber oxygen gas outlets and inlets formed on the center side of and adjacently to a cathode element along the plane of a cathode collector frame; and a cathode chamber which is the space between the gas diffusion electrode and the ion-exchange membrane and into which a caustic solution is to be introduced.

2. The electrolytic cell described in item 1 above, characterized in that the caustic solution passageway from each chamber is formed between parallel plate materials having a narrow gap and has spacers disposed therein at an interval of from 10 to 100 mm for the purposes of evenly dispersing a caustic solution and securing strength.

3. An electrolytic cell employing an anode, an ion-exchange membrane and an oxygen cathode comprising a gas diffusion electrode, characterized in that, in the electrolytic cell comprising: a gas chamber having oxygen gas feed openings for the gas diffusion electrode, the oxygen gas feed openings being connected to an oxygen gas feed part of a cathode element; and a caustic chamber which is the space between the gas diffusion electrode and the ion-exchange membrane and into which a caustic solution is to be introduced, a lower gas chamber is disposed as a gas discharge part under the gas chamber at the lower outer edge of the cathode element along the plane of a cathode collector frame.

4. An electrolytic cell employing an anode, an ion-exchange membrane and an oxygen cathode comprising a gas diffusion electrode, characterized in that a thin nickel frame having, in its upper and lower frame parts, caustic solution passage holes which meet caustic solution outlets and inlets of caustic chambers disposed in an upper and lower part of a cathode chamber frame, a thin nickel frame having comb-like slits in its upper and lower frame parts, and a thin nickel frame having no holes in its upper and lower frame parts are disposed in this order toward the ion-exchange membrane to constitute a caustic chamber frame and thereby constitute a caustic chamber having an exceedingly small thickness.

5. The electrolytic cell described in item 4 above, characterized in that the nickel frames are tightly sealed to each other with a sealing material or the nickel frames are united together by means of laser welding.

6. An electrolytic cell employing a gas diffusion electrode, characterized in that an upper gas chamber for oxygen gas introduction and a lower gas chamber for oxygen gas discharge are disposed on the inner side of a cathode element along the plane of a cathode collector frame so that the upper and lower gas chambers meet gas outlets and inlets formed in the upper and lower edges of a gas chamber having the gas diffusion electrode.

7. An electrolytic cell employing a gas diffusion electrode, characterized in that a gas- and liquid-permeable gas diffusion electrode is used as the gas diffusion electrode, and that an upper chamber connected to a gas chamber having the gas diffusion electrode and a lower chamber connected to the gas chamber are disposed along the plane of a cathode collector frame of a cathode. element on the upper and lower edges thereof to thereby respectively constitute a part for feeding oxygen gas and water and a part for discharging gas and caustic solution.

8. A method of power distribution in an electrolytic cell employing a gas diffusion electrode, characterized in that an oxygen cathode constituted of a gas diffusion electrode, a gas chamber and a cathode collector frame is disposed so that the cathode collector frame of the oxygen cathode faces a meshed metallic material of a cathode chamber frame conductor of a cathode element and a necessary planar pressure is maintained with a gas pressure to bring the cathode collector frame into contact with the meshed metallic material and electrically connect these.

BEST MODE FOR CARRYING OUT THE INVENTION

Embodiments of the invention will be explained below by reference to the drawings, but the invention should not be construed as being limited thereto.

Figure 1:
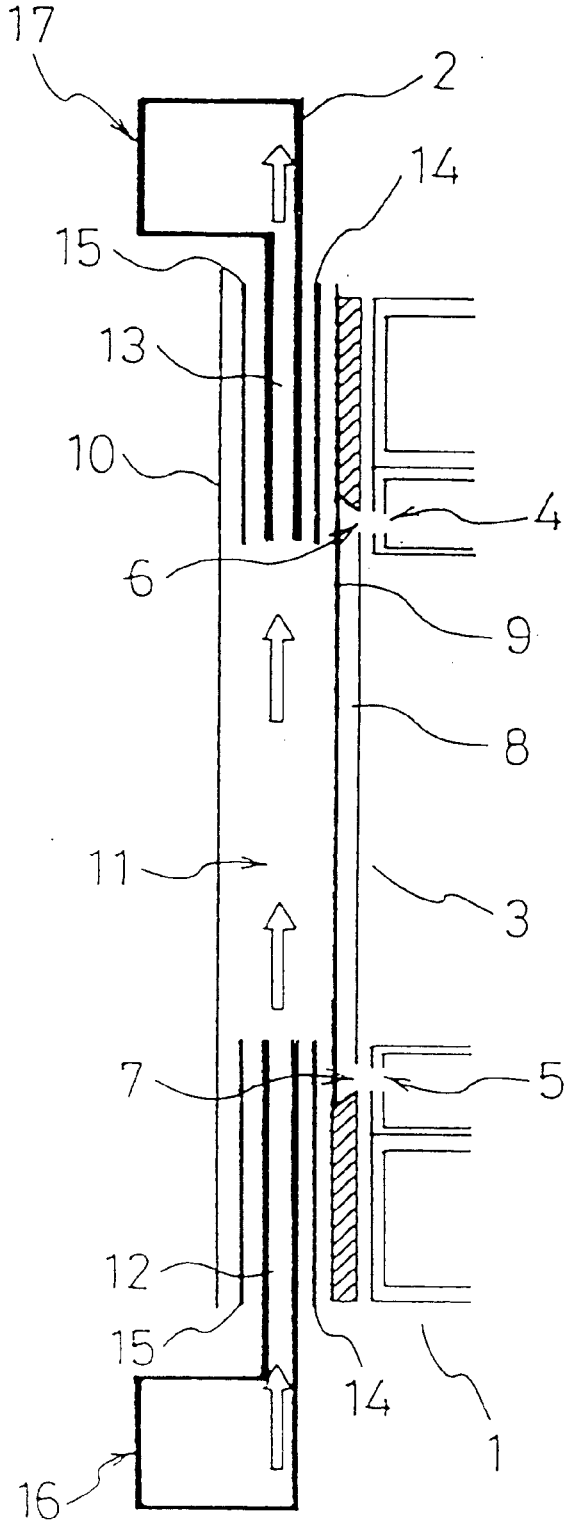
FIG. 1 is a sectional view illustrating one embodiment of the electrolytic cell of the invention of the type in which an upper chamber and lower chamber for feeding and discharging a caustic solution have been disposed.
Figure 9:
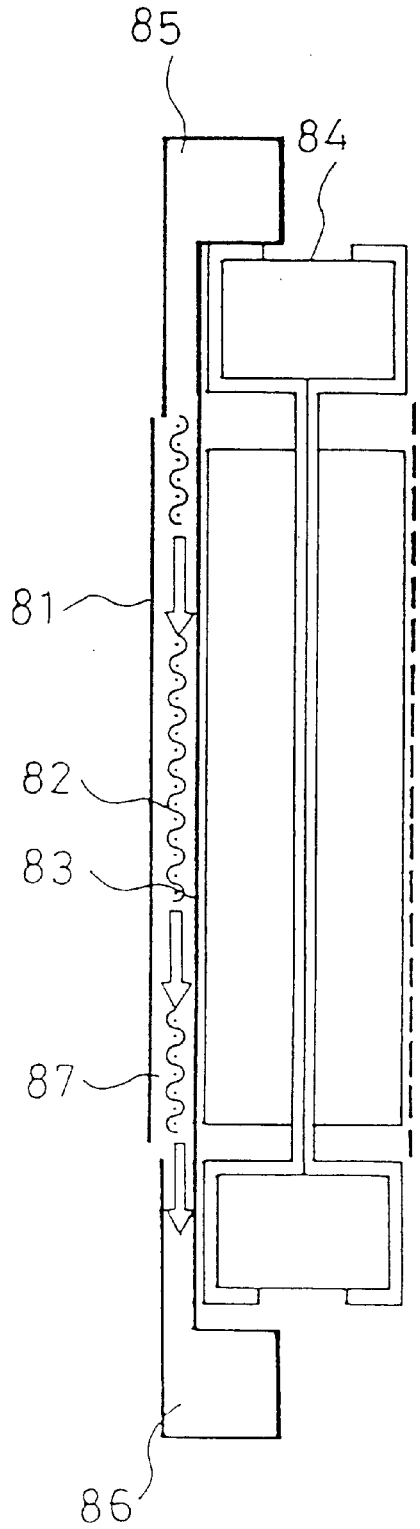
FIG. 9 is a sectional view illustrating one multi-pole embodiment.

FIG. 1 is a sectional view illustrating one embodiment of the electrolytic cell of the invention which employs a gas diffusion electrode and is of the type in which an upper chamber and lower chamber for feeding and discharging a caustic solution have been disposed (the sectional views given in up to FIG. 9 are vertical sectional views).

Upper-gas-chamber oxygen gas inlets 4 and lower-gas-chamber oxygen gas outlets 5 have been formed on the center side of and adjacently to a cathode element 1 of the electrolytic cell along the plane of a cathode collector frame 3. A gas chamber 8 is constituted by packing a corrugated mesh into the space between a gas diffusion electrode 9 and a cathode collector frame 3 having oxygen gas inlets 6 and outlets 7 which meet the oxygen gas inlets 4 and outlets 5. A cathode chamber 11 into which a caustic solution is to be introduced is constituted of the gas diffusion electrode 9 and an ion-exchange membrane 10.

This electrolytic cell has such a constitution that a gasket for preventing caustic solution and oxygen gas is interposed between the cathode collector frame 3 and the cathode element 1 to seal them. As this gasket for sealing, a gasket having alkali resistance can be used without particular limitations. For example, synthetic rubbers, plastics, and the like can be advantageously used.

On the other hand, an upper chamber 17 as caustic solution discharge openings and a lower chamber 16 as caustic solution introduction openings are disposed at outer edges of the cathode part of the thus-constituted electrolytic cell so that the chambers 17 and 16 are apart from the upper and lower edges of the cathode chamber 11 through caustic solution passageways 13 and 12, respectively. The caustic solution passageways 12 and 13 are preferably constituted of an upper frame part and lower frame part which are frame plates disposed apart in parallel at a short distance so as to constitute a narrow cathode chamber. Spacers have been disposed therein at an interval of from 10 to 100 mm for the purposes of evenly dispersing a caustic solution and securing strength. Furthermore, a gasket 14 and a gasket 15 are interposed respectively between the spacer type caustic solution passageways 12 and 13 and the cathode collector frame 3 and between the passageways 12 and 13 and the ion-exchange membrane 10 to thereby seal for the prevention of caustic solution leakage. As the material of the gaskets, the aforementioned alkali-resistant gaskets can be used without particular limitations.

The upper chamber 17 and lower chamber 16 of the cathode chamber 11 have been formed by sheet metal working from a metal sheet plated beforehand with a metal having resistance to corrosion by caustic soda, e.g., silver, in such a manner that the plated surface faces inside. Consequently, the chambers 17 and 16 can be easily produced and have excellent resistance to corrosion by caustic solution. There is no possibility that the upper and lower chambers 17 and 16 might suffer electrolytic corrosion. Furthermore, in the sheet metal working, the chambers 17 and 16 may be formed as a structure united with the cathode chamber frame 2.

As shown in FIG. 1, this embodiment of the invention is of the type in which an electrolytic solution is fed through a lower part thereof and ascends to higher parts. Namely, a caustic solution is fed through the lower chamber 16 of the cathode chamber 11, enters the caustic chamber 11 through the caustic solution passageway 12, ascends through the caustic chamber 11, and is discharged through the caustic solution passageway 13 and the upper chamber 17.

Figure 2:
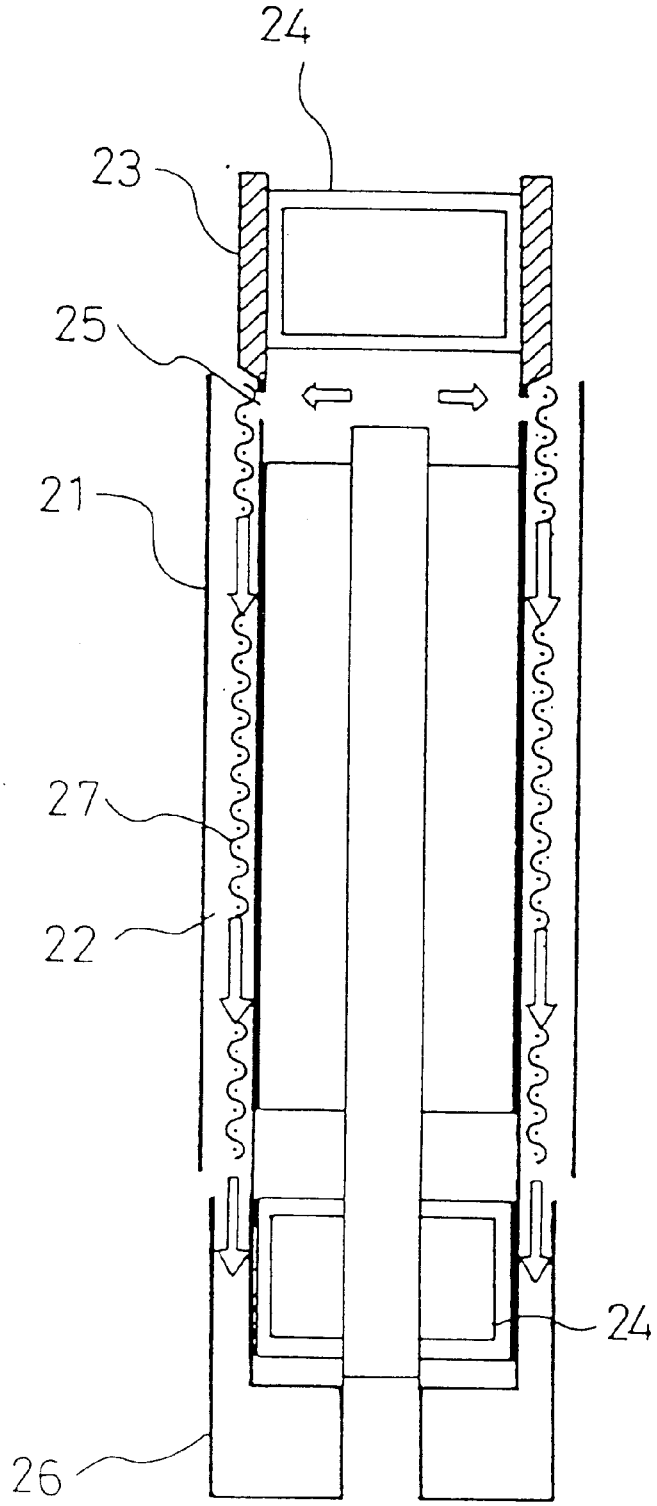
FIG. 2 is a sectional view illustrating one single-pole embodiment of the electrolytic cell of the invention of the type in which a lower gas chamber for gas discharge has been disposed for a gas diffusion electrode.
Figure 3:
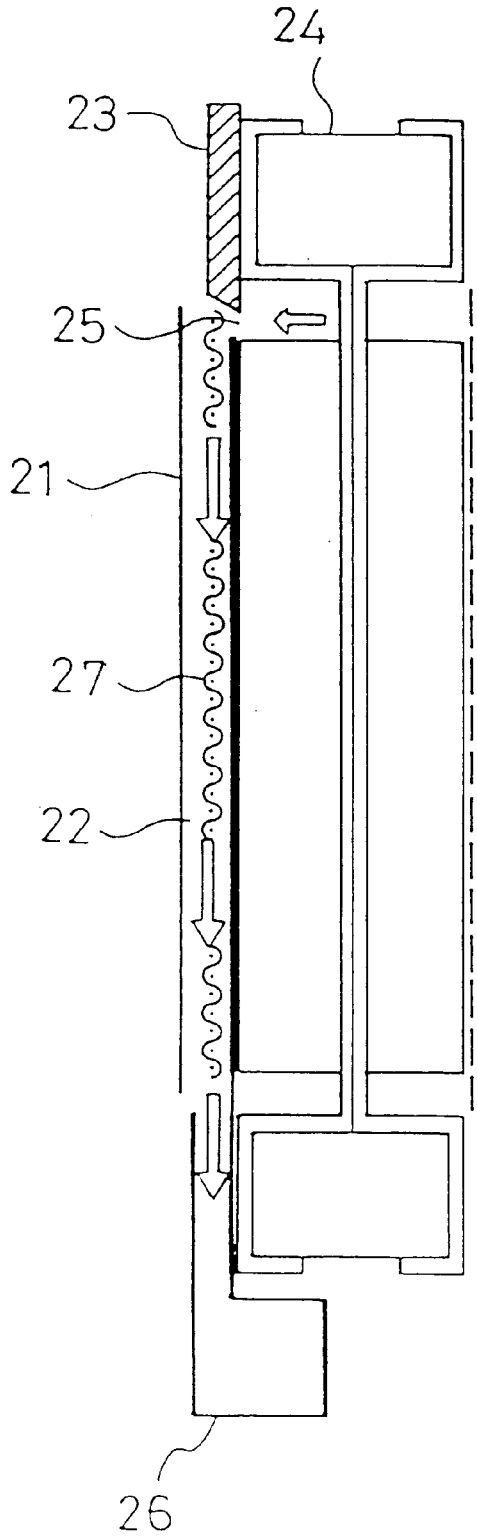
FIG. 3 is a sectional view illustrating one multi-pole embodiment.

FIG. 2 is a sectional view illustrating a single-pole embodiment of the electrolytic cell of the invention of the type in which a lower gas chamber for gas discharge into a gas diffusion electrode has been disposed, and FIG. 3 is a sectional view illustrating a multi-pole embodiment.

In FIG. 2 is shown a gas chamber 22 constituted of a gas diffusion electrode 21, a corrugated mesh 27, and a cathode collector frame 23 (which includes not only the hatched areas in an upper part but also the parts indicated by the lines extending under gas feed openings 25). The cathode collector frame 23 of the gas chamber 22 has gas feed openings 25 connected to an oxygen gas feed part of a cathode element 24. A lower gas chamber 26 has been disposed as a gas discharge part under the gas chamber 22 packed with the corrugated mesh 27 at the lower outer edge of the cathode element 24 along the plane of the cathode collector frame 23. This chamber 26 has been formed by sheet metal working from a metal sheet plated beforehand with, e.g., silver, having resistance to corrosion by caustic soda, in such a manner that the metal sheet faces inside.

In the embodiment shown in FIG. 2, oxygen gas is fed through a lower part of the cathode element 24, ascends through the inside of the cathode element 24, enters the gas chamber 22 through the gas feed openings 25 formed in an upper part of the cathode collector frame 23, and enters the lower gas chamber 26.

The electrolytic cell having a gas diffusion electrode of the invention has the constitution described above.

Consequently, even when the cell is operated at a fluid pressure higher than the gas pressure and the electrolytic solution (caustic solution) leaks out into the gas chamber in a large amount, then the caustic solution which has leaked out flows into the lower gas chamber 26. Hence, the leakage does not result in inhibition of gas feeding or a decrease in electrode performance, etc. Furthermore, even when the caustic solution leaks out through the gas diffusion electrode 21 into the lower gas chamber 26 because of insufficient sealing with the gasket, corrosion can be prevented by plating beforehand the inner surface of the lower gas chamber 26 so as to have resistance to corrosion by caustic soda. Thus, it is possible to prevent a caustic solution from flowing into the cathode element 24 to corrode the inside of the cathode element. Moreover, even in the case where the lower gas chamber 26 has corroded, the cell can be restored by replacing only the cathode collector frame 23 with a fresh one. Furthermore, this embodiment is applicable to any type of electrolytic cell because there is no need of modifying the existing cathode element.

Figure 4:
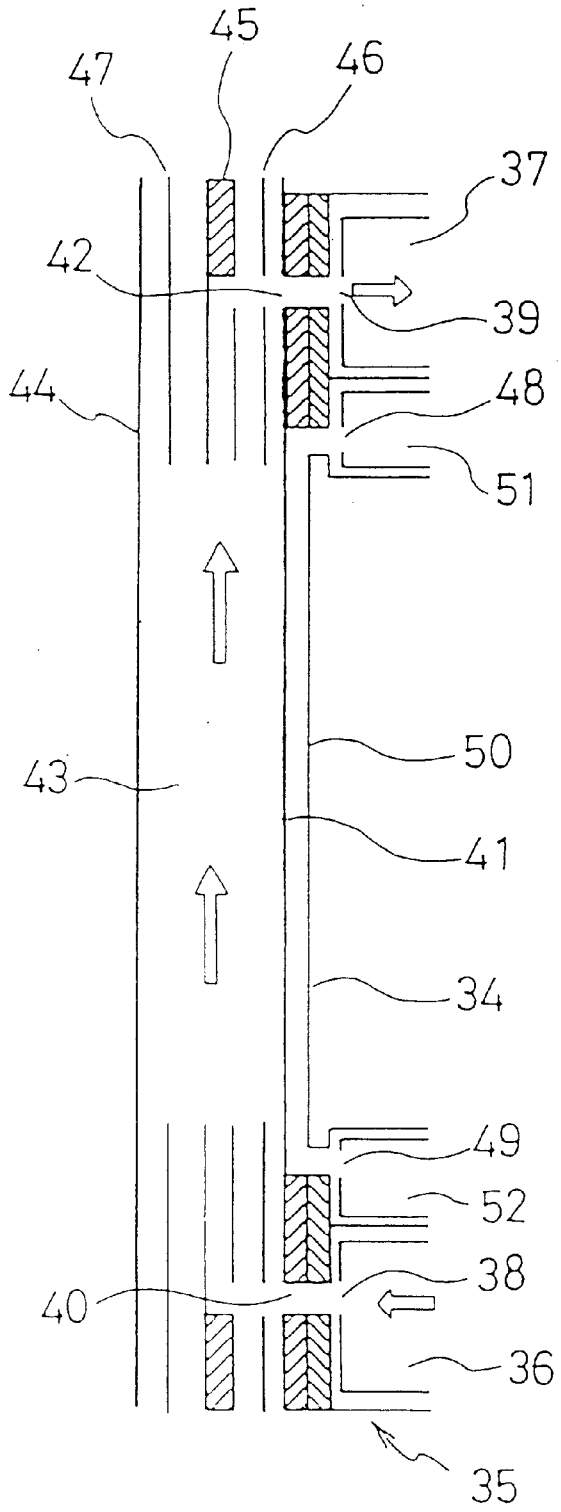
FIG. 4 is a sectional view illustrating one embodiment of the electrolytic cell of the invention of the type in which three thin frames are superposed to constitute a frame for a caustic chamber.
Figure 5:
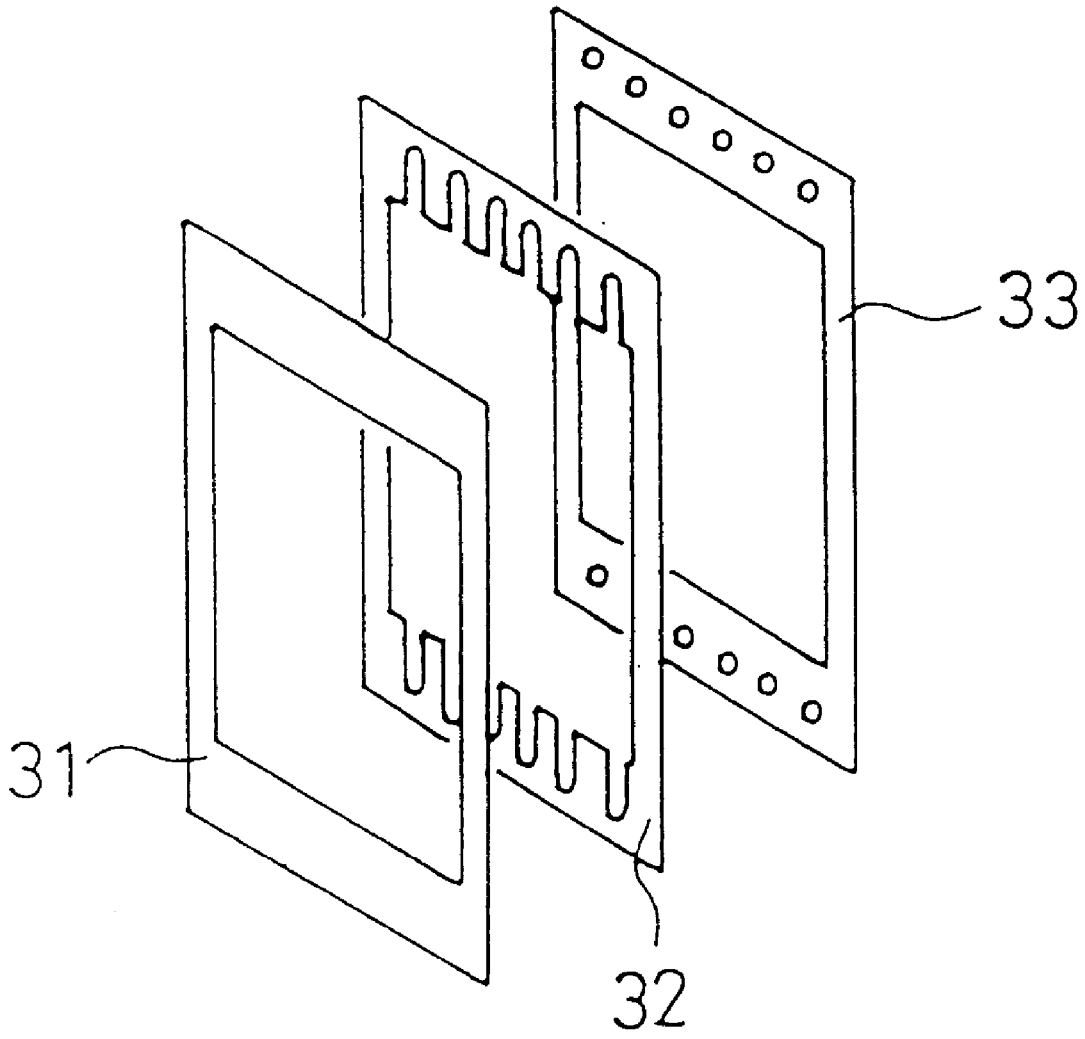
FIG. 5 is a slant view illustrating the structures of the nickel frames with which the caustic chamber frame is formed.

FIG. 4 is a sectional view of an electrolytic cell of the invention of the type in which a caustic chamber has been formed so as to have an exceedingly small thickness, and FIG. 5 is a slant view illustrating the structures of the nickel frames with which a caustic chamber frame is formed.

In the invention, as shown in FIG. 4, a cathode collector frame 34 of a gas diffusion electrode 41 is attached to the conductive rib of a cathode element 35 by the plug-in method or welding. A gas chamber is formed by the gas diffusion electrode 41, a corrugated mesh 50 (not shown), and the cathode collector frame 34. An upper and lower gas chamber 51 and 52 having gas outlets and inlets have been disposed at the upper and lower edges of the cathode part of the electrolytic cell. On the other hand, an upper and lower caustic chamber 36 and 37 of the cathode element have caustic solution inlet and outlet holes 38 and 39 on the flanged side thereof. The cathode collector frame 34 has caustic solution passage holes 40 and 42 which meet the caustic solution inlet and outlet holes 38 and 39.

An shown in FIG. 5, a thin nickel plate (3) 33 having caustic solution passage holes in its upper and lower frame parts, a thin nickel plate (2) 32 having comb-like slits in its upper and lower frame parts, and a thin nickel plate (1) 31 which has no means for passing caustic solution, e.g., holes, in its upper and lower frame parts are disposed in this order toward the ion-exchange membrane 44 in order to constitute a cathode chamber 43 between the gas diffusion electrode 41 and the ion-exchanged membrane 44. In FIG. 4, the nickel plates are used as nickel frames.

In FIG. 5 is shown a slant view which illustrates the frame structures of these nickel plates 31, 32, and 33 and the structures of the upper and lower frame parts having holes or comb-like slits for caustic solution passage. The thickness of the nickel plate (1) 31 on the ion-exchange membrane side is 0.5 mm, that of the central nickel plate (2) 32 is 1 mm, and that of the nickel plate (3) 33 on the cathode element side is 0.5 mm. The total thickness of these is as small as 2 mm. The caustic chamber 43 can be thus formed so as to have an exceedingly small thickness. It is preferred that the frame parts of these plates be tightly sealed to each other with a sealing material or laser-welded with each other to form the caustic chamber frame 45 as a united structure.

A sealing material having alkali resistance can be used, without particular limitations, as the sealing material for sealing the adjacent frames to each other in order to prevent caustic soda solution leakage through spaces between these nickel plates. For example, synthetic rubbers and synthetic resins, in particular high-performance sealing materials such as the modified silicone type and thiokol type, can be advantageously used.

Gaskets 46 and 47 are further disposed before and after the caustic chamber frame 45 in order to prevent caustic solution leakage. A gasket material having alkali resistance can be used, without particular limitations, as this gasket material for preventing the oozing of caustic soda solution. For example, synthetic rubbers, plastics, and the like can be advantageously used.

Furthermore, the cathode collector frame 34 has oxygen gas outlets and inlets formed on the center side of and respectively adjacently to the upper and lower caustic chambers 36 and 37 along the plane of the cathode collector frame 34 so that they meet oxygen outlets and inlets 48 and 49 of the upper gas chamber 51 and lower gas chamber 52.

Also between the oxygen outlets and inlets 48 and 49 and the oxygen gas outlets and inlets of the cathode collector frame 34 is interposed a gasket in the same manner as in the case of the caustic chamber frame 45. This gasket may be made of the same gasket material as those disposed before and after the caustic chamber frame 45, and may be an integrally formed one.

In this type of electrolytic cell of the invention, a caustic solution (electrolytic solution) is fed through a lower part thereof and ascends as shown in FIG. 4. Namely, a caustic solution is fed through the caustic solution inlet holes 38 of the lower caustic chamber 36 of the cathode element 35, passes through holes of the cathode collector frame 34 and gasket 46, passes through caustic solution passage holes of the nickel frame 33 of the caustic chamber frame 45, reaches the central nickel frame 32, and flows into the caustic chamber 43 through slits formed in the frame 32. The caustic solution ascends through the caustic chamber 43, passes through those slits of the central nickel frame 32 of the cathode chamber frame 45 which are located above the caustic chamber 43, passes through holes of the gasket 46 and the caustic solution passage holes 42 of the cathode collector frame 34, reaches the upper caustic chamber 37 through the caustic solution outlets 39, and is discharged.

As stated above, in this type of electrolytic cell of the invention, the nickel frames constituting the caustic chamber frame 45 for forming the caustic chamber 43 have a total plate thickness as small as 2 mm, so that the caustic chamber 43 can be formed so as to have an exceedingly small thickness. As a result, electrical resistance becomes low and the voltage required for operating the electrolytic cell can be reduced.

Figure 6:
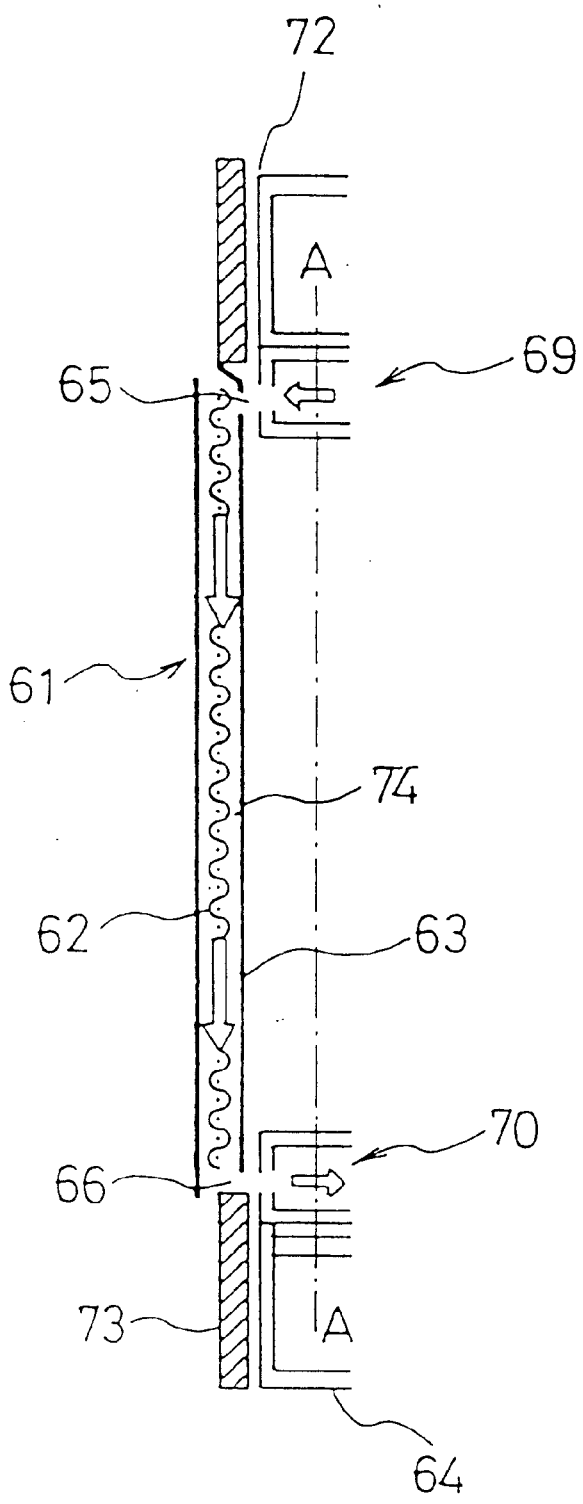
FIG. 6 is a sectional view illustrating an embodiment of the electrolytic cell of the invention of the type in which an upper gas chamber and a lower gas chamber have been disposed beside gas outlets and inlets formed in a gas chamber having a gas diffusion electrode.
Figure 7:
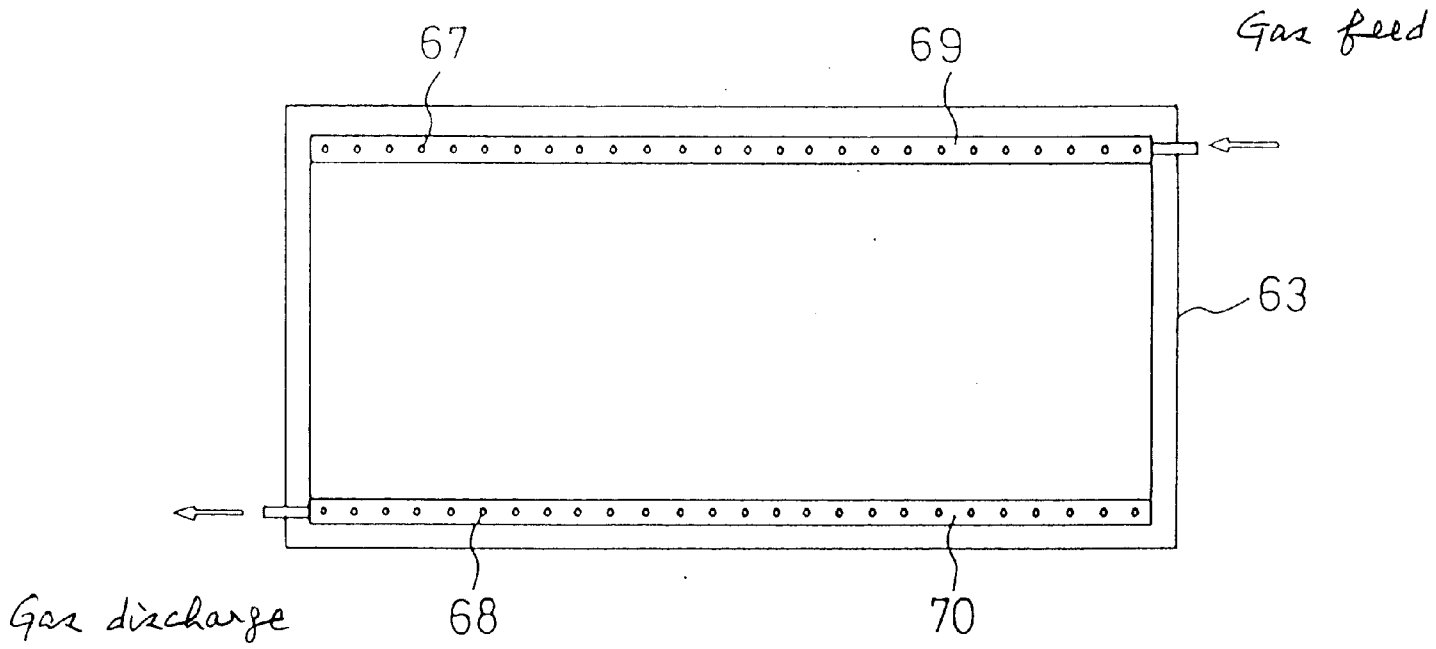
FIG. 7 is a front view of a cathode frame having attached thereto an upper and lower chamber having many feed holes and discharge holes for oxygen gas.

FIG. 6 is a sectional view of an electrolytic cell of the invention of the type in which an upper gas chamber and a lower gas chamber have been disposed beside gas outlets and inlets formed in a gas chamber having a gas diffusion electrode, and FIG. 7 is a front view of a cathode frame. having attached thereto an upper and lower gas chamber having many feed openings and discharge openings for oxygen.

An explanation is given by reference to FIG. 6 and FIG. 7. The cathode collector frame 63 of a gas chamber formed by a gas diffusion electrode 61, a corrugated mesh 62, and a cathode collector frame 63 is attached to the conductive rib of a cathode element 64 by the plug-in method or welding. In an upper and lower part of the cathode collector frame 63, oxygen inlet holes 65 and outlet holes 66 have been formed for the feeding and distribution of oxygen gas. An upper gas chamber 69 having oxygen feed openings 67 for oxygen gas feeding and a lower gas chamber 70 having oxygen discharge openings 68 have been attached to the inner side of the cathode element 64 along the plane of the cathode collector frame 63 so that the chambers 69 and 70 meet the inlet holes 65 and outlet holes 66. This electrolytic cell has such a constitution that gaskets 72 and 73 for gas leakage prevention are interposed between the upper and lower gas chambers 69 and 70 and the upper and lower edges of the cathode collector frame 63 to seal them. As the material of these gaskets for oxygen gas leakage prevention, gasket materials for low-pressure sealing can be used without particular limitations, such as rubbers, leathers, asbestos, paper, plastics, etc. Preferably used of these are synthetic rubbers and plastics having excellent elastic recovery.

Incidentally, FIG. 7 is a sectional view taken on the line A—A of FIG. 6, and illustrates the state of the upper and lower gas chambers which have been disposed for the cathode collector frame 71 and in which an array of feed openings and array of discharge openings for evenly feeding and discharging oxygen gas in the width direction for the gas diffusion electrode have been formed.

In the electrolytic cell according to the invention of the type in which an upper gas chamber and a lower gas chamber have been disposed beside gas outlets and inlets formed in a gas chamber having a gas diffusion electrode, oxygen gas is introduced through the oxygen feed holes 67 formed in the upper gas chamber 69, is fed to the gas chamber 74 through the oxygen inlet holes 65 formed in an upper part of the cathode collector frame 63, descends through the gas chamber 74, and is discharged through the oxygen outlet holes 66 formed in a lower part of the cathode collector frame 63 and through the oxygen discharge holes 68 formed in the lower gas chamber 70.

As a result, since the oxygen gas which has entered through the oxygen inlet holes 65 is discharged through the oxygen outlet holes 66, oxygen is more evenly fed to the whole gas chamber 74 having the gas diffusion electrode 61 than in the case of conventional gas chambers, and oxygen is evenly diffused into the gas diffusion electrode. Furthermore, the structure in which the upper and lower gas chambers 69 and 70 are in contact with the cathode element 64 eliminates the necessity of especially disposing a complicated power discharge mechanism. For this purpose, the material of the upper and lower gas chambers 69 and 70 is preferably the same as the material of the cathode element 64.

Figure 8:
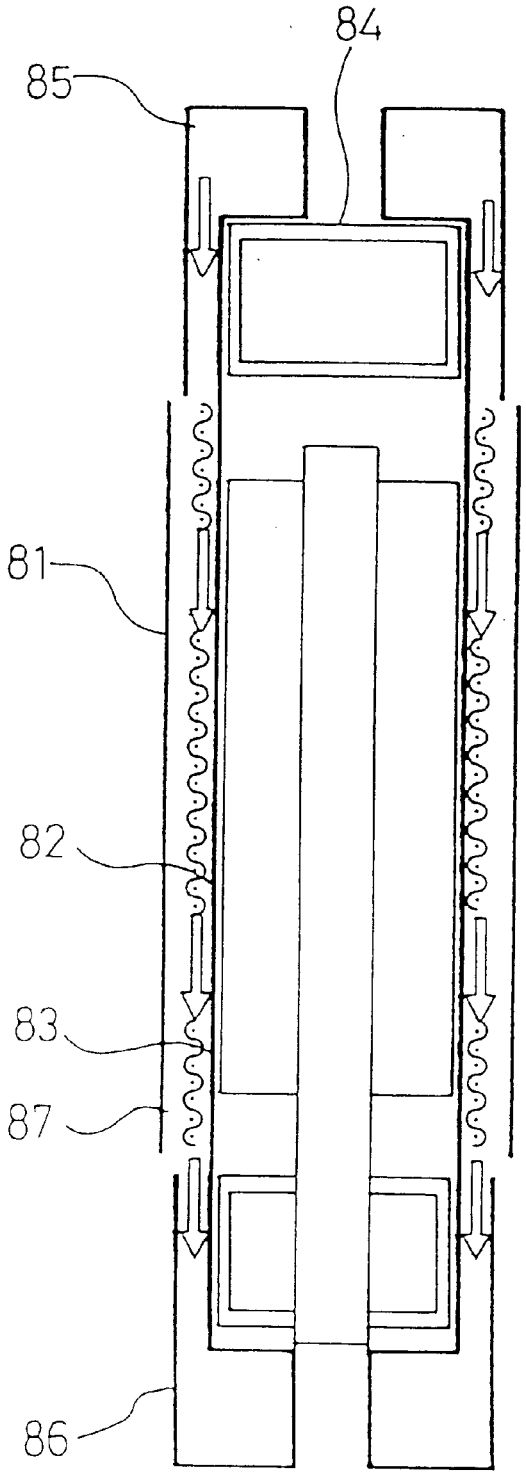
FIG. 8 is a sectional view illustrating one single-pole embodiment of the electrolytic cell of the invention of the type which employs a gas- and liquid-permeable gas diffusion electrode and has an upper and lower gas chamber.

FIG. 8 is a sectional view illustrating a single-pole embodiment of the electrolytic cell of the invention of the type which employs a gas- and liquid-permeable gas diffusion electrode and has an upper and lower gas chamber, and FIG. 9 is a sectional view illustrating a multi-pole embodiment.

An explanation is given by reference to FIG. 8. An upper chamber 85 connected to a gas chamber 87 constituted of a gas- and liquid-permeable gas diffusion electrode 81, a gas chamber component 82, and a cathode collector frame 83 is disposed, as a part for feeding oxygen gas and water, along the plane of the cathode collector frame 83 of the gas chamber 87 on the upper and lower outer edges thereof. Simultaneously therewith, a lower gas chamber 86 connected to the gas chamber component 82 is disposed, as a part for discharging oxygen gas and caustic solution, under the cathode chamber frame 83. The chambers 85 and 86 are produced by metal plate working from a metal sheet plated beforehand with, e.g., silver, having resistance to corrosion by caustic soda, in such a manner that the metal sheet faces inside.

It is essential in this invention that the gas diffusion electrode should have gas and liquid permeability. In this respect, this electrode is essentially different from conventional gas electrodes having gas and liquid permeability. Consequently, the gas electrode to be used in the invention cannot be produced by any of conventional processes, and should be produced by a special process. Although this process is not particularly limited, a gas diffusion electrode usable in the invention can be produced by using as a substrate a conductive material having fine pores of, for example, about from several micrometers to tens of micrometers, such as a carbon cloth, metal fibers, or a metal sinter, applying a mixture of a carbon powder and a water-repellent material such as PTFE to one or both sides of the substrate, burning the coating to form a gas diffusion layer, and further depositing a catalyst, e.g., platinum or silver, by a pyrolytic method or another method on the side which is to come into contact with an ion-exchange membrane or forming a catalyzed thin layer of carbon particles and PTFE.

Moreover, the conductive porous material which is the gas chamber component and serves to supply electricity to the gas electrode is produced from a material having alkali resistance. Although it is preferred to use a metal such as, e.g., stainless steel or nickel, a carbonaceous material may be used. The shape thereof is desirably an expanded mesh, woven mesh, punching plate, metal fiber web, cloth type, etc. Also used advantageously are metal sinters and the metal foam commercially available under the trade name of CELMET (manufactured by Sumitomo Electric Industries, Ltd.).

Furthermore, a gas- and liquid-permeable, sheet-form gas diffusion electrode obtained by depositing an electrode material which is a kneaded mixture comprising a carbonaceous material and PTFE on a gas chamber component 82, e.g., a porous sheet, so that the electrode material comes into contact with an ion-exchange membrane is attached to a cathode collector frame 83 comprising a porous metal. This electrolytic cell has such a constitution that the caustic soda which generates on the electrode material of the gas diffusion electrode 81 readily moves to the back cathode chamber in cooperation with the gas and liquid permeability of the gas diffusion electrode.

In this electrolytic cell of the invention, which has the constitution described above, both oxygen gas and water are fed through the upper chamber 85, pass through the gas chamber 87, and are discharged through the lower chamber 86.

Since the inside of the chambers 86 and 85 has been plated for corrosion prevention beforehand, corrosion by caustic solution can be prevented. Because of this, there is no possibility that the caustic solution might flow into the cathode frame 84 to corrode the element. Moreover, even in case of chamber corrosion, the cell can be restored by replacing the cathode collector frame 83 with a fresh one. In addition, this embodiment is applicable to any type of electrolytic cell because there is no need of modifying the existing element.

Figure 10:
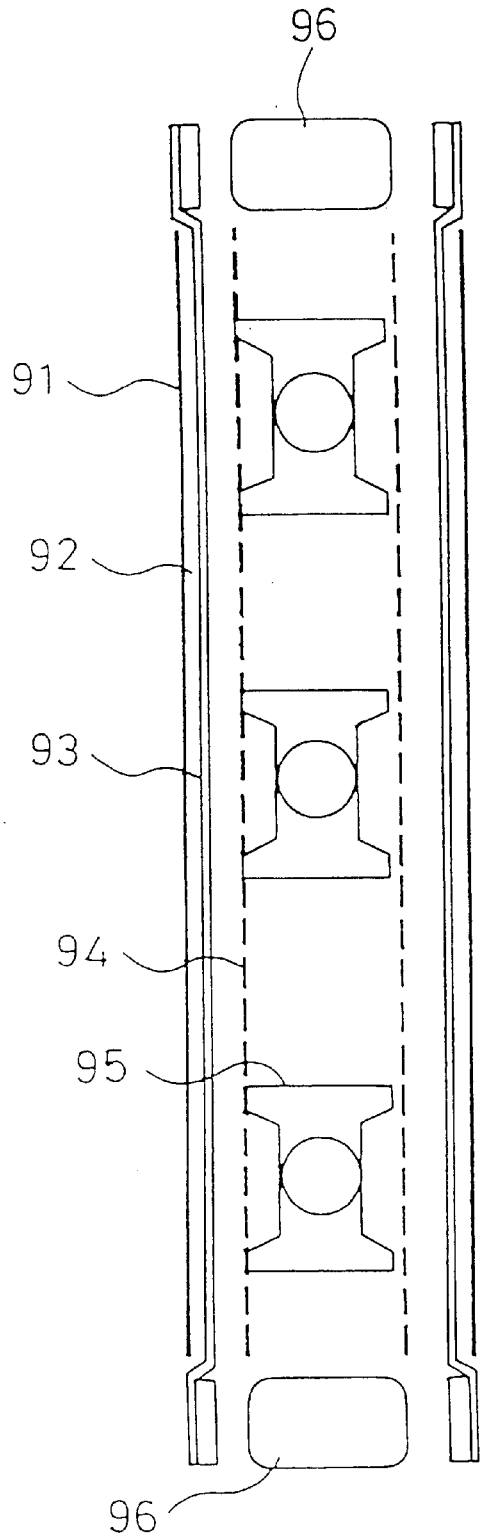
FIG. 10 is a cross-sectional view illustrating one single-pole embodiment of the method of power distribution of the invention in an electrolytic cell employing a gas diffusion electrode.
Figure 11:
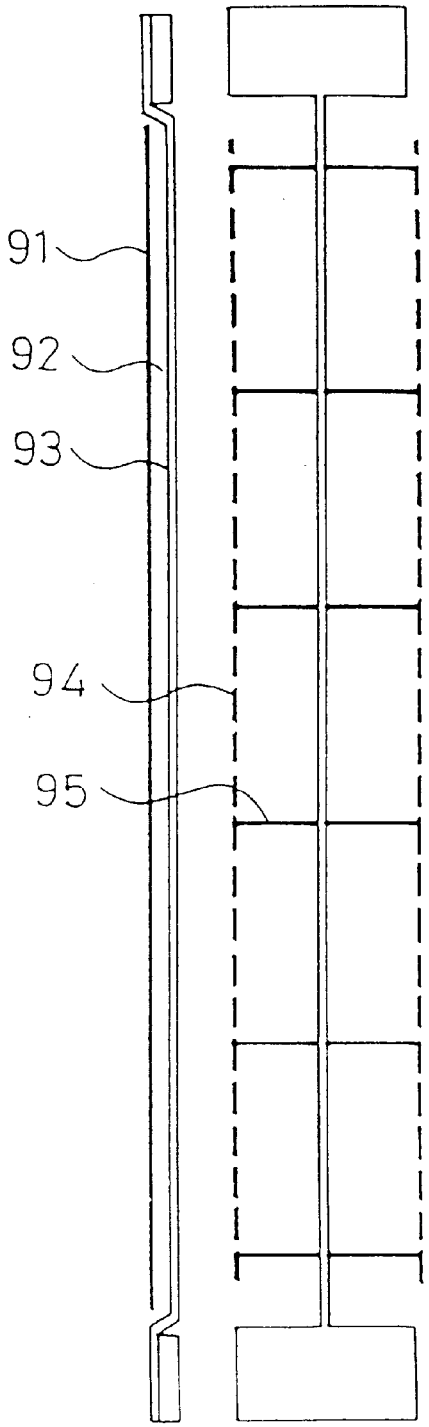
FIG. 11 is a cross-sectional view illustrating one multi-pole embodiment.

FIG. 10 is a cross-sectional view illustrating a single-pole embodiment of the method of power distribution of the invention in an electrolytic cell employing a gas diffusion electrode, and FIG. 11 is a cross-sectional view illustrating a multi-pole embodiment.

In FIG. 10, the gas diffusion electrode 91 of an oxygen cathode constituted of a gas diffusion electrode 91, a gas chamber 92, and a cathode collector frame 93 is attached to a cathode chamber frame conductor 95 of an electrolytic cell, while leaving a meshed metallic material 94 between the cathode collector frame 93 and the cathode chamber frame conductor 95 of a cathode element 96.

As described above, the cathode collector frame 93 of the gas diffusion electrode 91 is disposed so as to face the meshed metallic material 94 of the cathode chamber frame conductor 95. As a result, the cathode collector frame 93 comes into light contact with the meshed metallic material 94 in several positions. When oxygen gas is introduced into the gas chamber 92 of the cell in this state, then the two members come into contact with each other in many positions due to the planar pressure resulting from the gas pressure. By maintaining this necessary planar pressure, the two members are electrically connected to each other and power is distributed to the gas diffusion electrode 91 and the electrolytic cell.

Examples of the metallic material having alkali resistance and excellent conductivity used as the meshed metallic material 94 which is a conductor used in the invention include stainless steel, nickel, nickel alloys, and the like. Preferred from the standpoint of profitability are stainless steel and nickel.

In the invention, "meshed metallic material" means any of materials including ordinary metal gauzes and other forms such as, e.g., expanded metals and punching metals. Since it is unclear that the term "metal gauze", which is the most common, includes those materials, that term is especially used in this description.

INDUSTRIAL APPLICABILITY

According to the electrolytic cell of the invention of the type in which an upper chamber and lower chamber for feeding and discharging a caustic solution have been disposed, not only caustic solution leakage can be prevented, but also the caustic chamber does not suffer electrolytic corrosion because the upper chamber and lower chamber can be easily subjected to corrosion-preventive plating. Furthermore, by disposing spacers in the caustic solution passageways connecting the cathode chamber to the upper chamber and lower chamber, it becomes possible to evenly distribute and smoothly pass a caustic solution. Moreover, since the upper chamber and lower chamber are disposed outside the electrolytic cell, a conventional electrolytic cell can be modified without changing the internal structure thereof.

According to the electrolytic cell of the invention of the type in which a lower gas chamber for gas discharge into a gas diffusion electrode has been disposed, it has the lower gas chamber disposed as a gas discharge part under the gas chamber having the gas diffusion electrode at the lower outer edge of the cathode element along the plane of a cathode collector frame. Consequently, even if the caustic solution leaks out into the gas chamber in a large amount, it flows into the lower gas chamber. Hence, the leakage does not result in inhibition of gas feeding and in a decrease in electrode performance. Moreover, even if the lower chamber corrodes, the cell can be restored by merely replacing the cathode collector frame with a fresh one. Furthermore, this embodiment is applicable to any type of electrolytic cell regardless of whether it is a single-pole or multi-pole one, because there is no need of modifying the existing element.

According to the electrolytic cell of the invention of the type in which a frame for a caustic chamber is constituted by superposing three thin frames, the caustic chamber of the electrolytic cell can be made to have a small thickness and liquid feeding to the caustic chamber can be conducted evenly and smoothly. Consequently, the operating voltage can be reduced. Furthermore, when this electrolytic cell is of the type in which a caustic solution is fed through the caustic solution inlets of the lower caustic chamber and forcedly caused to ascend through the caustic chamber, then the caustic solution which has been evenly fed to the caustic chamber through many comb-like slits ascends through the caustic chamber while evenly dispersing in the chamber, without the need of disposing a special caustic solution passageway even when the caustic chamber is extremely thin. Thus, even electrolysis is possible.

According to the electrolytic cell of the invention of the type in which an upper gas chamber and a lower gas chamber have been disposed beside gas outlets and inlets formed in a gas chamber having a gas diffusion electrode, oxygen more evenly comes into contact with the gas diffusion electrode as compared with the conventional technique for even gas diffusion based on the structure of a gas chamber having a gas diffusion electrode, because the chambers having many oxygen gas feed holes and discharge openings have been disposed on the inner side of the cathode element along the plane of the cathode collector frame so as to meet the gas outlets and inlets formed in the upper and lower edges of the gas chamber having the gas diffusion electrode. As a result, highly satisfactory oxidation-reduction reactions occur on the gas diffusion electrode, and the cathode potential decreases. Consequently, the electrolytic voltage decreases considerably. Furthermore, the invention can provide a constitution in which oxygen gas can be evenly fed to and discharged from the gas chamber having a gas diffusion electrode without changing the structure of a conventional electrolytic cell.

According to the electrolytic cell of the invention of the type which employs a gas diffusion electrode having gas and liquid permeability and has an upper and lower gas chamber, an even higher current efficiency and highly stable electrolytic operation can be continued because water and oxygen gas are directly introduced into the gas chamber component comprising a conductive porous material from the upper chamber. Furthermore, in case of chamber corrosion, the cell can be restored by merely replacing the whole cathode collector frame with a fresh one. This type further has an advantage that it is applicable to any type of electrolytic cell regardless of whether it is singlepole or multi-pole one.

According to the electrolytic cell of the invention of the type in which an electrical connection is established with respect to an oxygen cathode comprising a gas diffusion electrode, a gas chamber, and a cathode collector frame, there is no need of attaching a conductive rib to the cathode collector frame or removing the existing meshed metallic material, e.g., metal mesh, attached to a cathode element. This type is applicable to either a single-pole electrolytic cell or a multi-pole electrolytic cell without modifying the existing element at all. Furthermore, since the cathode collector frame comes into contact with the meshed metallic material in many positions, the electrical-conduction distance between the cathode collector frame and the cathode chamber frame conductor is reduced, resulting in reduced electrical resistance. Consequently, the electrical energy efficiency can be increased.

What is claimed is:

1. An electrolytic cell employing an anode, an ion-exchange membrane and an oxygen cathode comprising a gas diffusion electrode, characterized in that a caustic chamber frame comprising an upper chamber, as caustic solution discharge openings, and a lower chamber, as caustic solution introduction openings, which are connected to each other through caustic solution passageways is disposed at outer edges of the electrolytic cell which comprises: a gas chamber having oxygen gas outlets and inlets for the gas diffusion electrode which meet upper- and lower-chamber oxygen gas outlets and inlets formed on the center side of and adjacently to a cathode element along the plane of a cathode collector frame; and a cathode chamber which is the space between the gas diffusion electrode and the ion-exchange membrane and into which a caustic solution is to be introduced.

2. The electrolytic cell of claim 1, characterized in that the caustic solution passageway from each chamber is formed between parallel plate materials having a narrow gap and has spacers disposed therein at an interval of from 10 to 100 mm for the purposes of evenly dispersing a caustic solution and securing strength.

3. An electrolytic cell employing an anode, an ion-exchange membrane and an oxygen cathode comprising a gas diffusion electrode, characterized in that, in the electrolytic cell comprising: a gas chamber having oxygen gas feed openings for the gas diffusion electrode, the oxygen gas feed openings being connected to an oxygen gas feed part of a cathode element; and a caustic chamber which is the space between the gas diffusion electrode and the ion-exchange membrane and into which a caustic solution is to be introduced, a lower gas chamber is disposed as a gas discharge part under the gas chamber at the lower outer edge of the cathode element along the plane of a cathode collector frame.

4. An electrolytic cell employing an anode, an ion-exchange membrane and an oxygen cathode comprising a gas diffusion electrode, characterized in that a thin nickel frame having, in its upper and lower frame parts, caustic solution passage holes which meet caustic solution outlets and inlets of caustic chambers disposed in an upper and lower part of a cathode element, a thin nickel frame having comb-like slits in its upper and lower frame parts, and a thin nickel frame having no holes in its upper and lower frame parts are disposed in this order toward the ion-exchange membrane to constitute a caustic chamber frame and thereby constitute a caustic chamber having an exceedingly small thickness.

5. The electrolytic cell of claim 4, characterized in that the nickel frames are tightly sealed to each other with a sealing material or the nickel frames are united together by means of laser welding.

6. An electrolytic cell employing a gas diffusion electrode, characterized in that an upper gas chamber for oxygen gas introduction and a lower gas chamber for oxygen gas discharge are disposed on the inner side of a cathode element along the plane of a cathode collector frame so that the upper and lower gas chambers meet gas outlets and inlets formed in the upper and lower edges of a gas chamber having the gas diffusion electrode.

7. An electrolytic cell employing a gas diffusion electrode, characterized in that a gas- and liquid-permeable gas diffusion electrode is used as the gas diffusion electrode, and that an upper chamber connected to a gas chamber having the gas diffusion electrode and a lower chamber connected to the gas chamber are disposed along the plane of a cathode collector frame of a cathode element on the upper and lower edges thereof to thereby respectively constitute a part for feeding oxygen gas and water and a part for discharging gas and caustic solution.

8. A method of power distribution in an electrolytic cell employing a gas diffusion electrode, characterized in that an oxygen cathode constituted of a gas diffusion electrode, a gas chamber and a cathode collector frame is disposed so that the cathode collector frame of the oxygen cathode faces a meshed metallic material of a cathode chamber frame conductor of a cathode element and a necessary planar pressure is maintained with a gas pressure to bring the cathode collector frame into contact with the meshed metallic material and electrically connect these.

* * * * *